US006807854B2

(12) United States Patent
Peysson et al.

(10) Patent No.: US 6,807,854 B2
(45) Date of Patent: Oct. 26, 2004

(54) METHOD OF DETERMINING THE THERMAL PROFILE OF A DRILLING FLUID IN A WELL

(75) Inventors: Yannick Peysson, Paris (FR); Benjamin Herzhaft, Suresnes (FR)

(73) Assignee: Institut Francais du Petrole, Rueil-Malmaison cedex (FR)

( * ) Notice: Subject to any disclaimer, the term of this patent is extended or adjusted under 35 U.S.C. 154(b) by 67 days.

(21) Appl. No.: 09/985,730

(22) Filed: Nov. 6, 2001

(65) Prior Publication Data

US 2002/0096321 A1 Jul. 25, 2002

(30) Foreign Application Priority Data

Nov. 8, 2000 (FR) ..... 00 14305

(51) Int. Cl.[7] ..... E21B 47/10
(52) U.S. Cl. ..... 73/152.18
(58) Field of Search ..... 73/152.01, 152.21, 73/152.42, 152.18, 152.22, 152.52

(56) References Cited

U.S. PATENT DOCUMENTS 4,520,666 A * 6/1985 Coblentz et al. ..... 73/152.33
5,960,369 A * 9/1999 Samaroo ..... 702/6
6,305,216 B1 * 10/2001 Samaroo ..... 73/53.01

OTHER PUBLICATIONS

Prensky et al, Temperature Measurements in Boreholes: An Overview of Engineering and Scientific Applications, 1992.*

Santoyo et al, Thermal Evolution Study of the Tres LV–3 Well in the Virgenes Geothermal Field, Mexico, Proceedings, World Geothermal Congress, 2000.*

Hasan, et al.; "A mechanistic model for circulating fluid temperature, SPE paper No. 27848", SPE Journal, Jun. 1991 (; pps. 133–143; XP002176187.

Karstad et al.; "Analysis of temperature measurements during drilling, SPE Paper No. 38603"; SPE Ann. Tech Conf. And Exhib., Oct. 5–8, 1997, pps. 381–191, XP002176188, San Antonio, Texas.

Corre, et al; "Numerical computation of temperature distribution i a wellbore while drilling, SPE Paper No. 13208", 59$^{th}$ Tech. Conf. And Exhib., Sep. 16–19, 1984, XP002176189, Houston, Texas, USA.

French Search Report w/English translation.

IADC/SPE 62728, "Analysis of Extended Reach Drilling Data Using an Advanced Pressure and Temperature Model," by K.S. Bjørkevoil et al, Society of Petroleum Engineers, 2000 IADC/SPE Asia Pacific Drilling Technology, held in Kuala Lumpur, Malaysia, Sep. 11–13, 2000, pp. 1–7.

* cited by examiner

*Primary Examiner*—Robert Raevis
(74) *Attorney, Agent, or Firm*—Antonelli, Terry, Stout & Krausk, LLP

(57) ABSTRACT

A method providing real-time determination of a thermal profile of the drilling fluid in a well from three measuring points available in the field, i.e. the injection temperature, the outlet temperature and the bottomhole temperature is disclosed. The form of the profile between these three points is defined by a type curve representative of the thermal profiles in a well under drilling, estimated from physical considerations on thermal transfers in the well.

36 Claims, 5 Drawing Sheets

METHOD OF DETERMINING THE THERMAL PROFILE OF A DRILLING FLUID IN A WELL

BACKGROUND OF THE INVENTION

Field of the Invention

The present invention relates to a method of determining the thermal profile of a drilling fluid in a well.

During drilling, which is the mud injected into the drill string of the well and which flows back through the corresponding annulus, undergoes great temperature variations. The fluid can encounter temperatures that can range from 2° C. for deep offshore wells to more than 180° C. for very hot wells. Many mud properties, such as rheology or density, depend on the temperature. Calculation of the pressure losses during drilling can therefore be improved if an estimation of the temperature profile in the well is known. It is therefore important to be able to predict the temperature profile in the flowing mud from well data and mud characteristics.

Measurement of the thermal profile of the fluid in a well under drilling would require complete instrumentation of the well, that is installation of evenly spaced out detectors in the drill string and in the annulus, allowing temperature measurement at various depths. However, installing such a measuring system entails too many constraints; only localized measurements picked up by devices mounted in the drill string allow knowing certain temperature points on the path of the drilling fluid.

In the face of this lack of data, analytic models based on heat transfer equations have been developed to evaluate the thermal profiles of the fluid along the well under drilling. Some of these analytic models are implemented in softwares and allow providing an estimation of thermal profiles from a data which may be difficult to obtain. Thus, knowing the characteristics of the site and of the drilling equipment, by giving a value of the temperature of the fluid at the well inlet, these softwares can predict the temperature profile of the drilling fluid.

However, a comparison between the results obtained with analytic methods and the measurements obtained in the field shows that there can be great differences. Furthermore, the complexity of softwares using numerical calculation methods makes real-time implementation thereof difficult.

On the other hand, a study of the bibliography on thermal models shows a similarity in the form of temperature profiles in most cases, which turns on three points: inlet temperature, outlet temperature and bottomhole temperature.

The aim of this study is thus to provide a method allowing real-time determination of a thermal profile in the mud from three measuring points available in the field, that is the injection temperature, the outlet temperature and the bottomhole temperature measured by a detector mounted on the string. The form of the profile between these three points is represented by a type curve representative of the thermal profiles in a well under drilling, estimated from physical considerations on thermal transfers in the well.

SUMMARY OF THE INVENTION

The method of determining the thermal profile of a drilling fluid circulating in a well under drilling according to the invention is defined by the successive stages as follows:

a) determining a general expression θ1 for the thermal profile of the fluid within the drill string in the well and a general expression θ2 for a thermal profile of the fluid in the corresponding annulus, using the heat propagation equation that takes into account a thermal profile of the medium surrounding the well, b) measuring the temperature of the fluid at the well inlet, T1, at the well bottom, T2, and at the well outlet, T3, c) modifying the expressions θ1 and θ2 to meet the temperature boundary conditions T1, T2 and T3, d) determining the thermal profile of the drilling fluid as a function of the depth.

In order to obtain, in real time, a temperature profile with the method presented above, stages b), c) and d) can be repeated.

According to the method of the invention, in stage a), general expressions θ1 and θ2 can comprise unknown constants, and in stage c), it can be determined that expressions θ1 and θ2 meet the temperature boundary conditions T1, T2 and T3 by determining the unknown constants.

In order to determine a general expression θ1 for the thermal profile of the fluid within the drill string in the well and a general expression θ2 for a thermal profile of the fluid in the corresponding annulus, it is possible, according to the method of the invention, to use in stage a) the heat propagation equation that takes into account at least the thermal equation of the medium surrounding the well, the flow rate of the fluid and the balance of the thermal exchanges undergone by the fluid, the thermal exchanges comprising at least the exchanges between the ascending and descending drilling fluid, and/or to use the equation of heat propagation in a homogeneous medium on a cylinder of infinite height centered on the well, the cylinder comprising the drill string that guides the descending fluid and the annulus around said drill string, which guides the ascending fluid.

According to the method of the invention, general expressions θ1 and θ2 obtained in stage a) can be split up into several independent equations and, in stage c), it can furthermore be determined that the profiles and the derivatives of the thermal profiles of the fluid within the drill string and in the corresponding annulus are continuous.

The method according to the invention can notably be used to calculate the pressure drops of the drilling fluid circulating in a well under drilling, or in another application, to determine the zones of hydrate formation in the fluid during drilling.

In relation to the methods for determining the thermal profile of a drilling fluid in a well according to the prior art, the present invention notably affords the following advantages:

- the temperature profile obtained is more accurate because it is determined from three drilling fluid temperature measurement points while keeping an analytic expression of the thermal profile between the measuring points which is physically justified,
- since the temperature measurements are performed all the time, the method allows obtaining the temperature profile in real time and to observe the evolution thereof with time.

BRIEF DESCRIPTION OF THE DRAWINGS

Other features and advantages of the present invention will be clear from reading the description hereafter of non-limitative examples, with reference to the accompanying drawings wherein.

DETAILED DESCRIPTRION OF THE PREFERRED EBMODIMENTS

It is possible to give an analytic expression for the thermal profile in the well and the annulus by using quite simple heat exchange considerations, that is the heat propagation equation.

This model is based on the establishment of the heat balances in the well. According to a first approach, only the steady states are considered (the drilling mud flow is assumed to be stabilized for some time so that the temperatures no longer evolve). Certain hypotheses are necessary for calculation: the heat exchanges are measured in a plane perpendicular to the laminar flow of the mud, the various constants are assumed to be independent of the temperature, and finally the influence of the temperature of the medium surrounding the well shows on an apriori selected useful diameter Rf.

Figure 1:
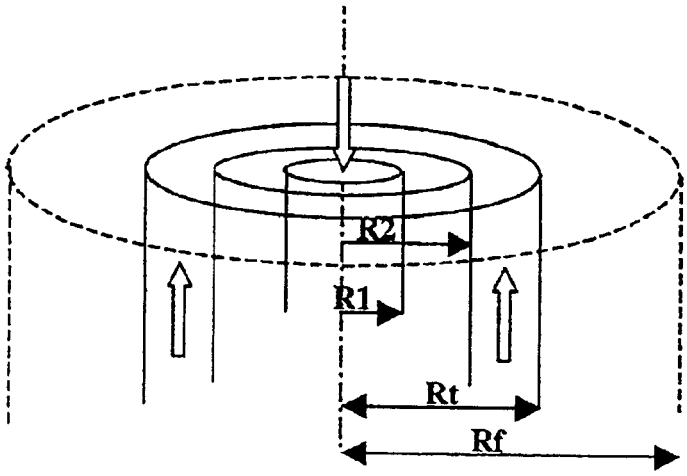
FIG. 1 diagrammatically shows the architecture of a well under drilling.

It is then sufficient to use the heat propagation equation in a homogeneous medium on a cylinder of infinite height centered on the well shown in FIG. 1. In each well section, the heat loss equality is written by considering two temperature functions: $\theta_1(z)$ within the drill string and $\theta_2(Z)$ in the annulus.

Let $\theta_f$ be the temperature of the formation, $\lambda_f$ the thermal conductivity of the medium surrounding the well, $\lambda_a$ the thermal conductivity of the tubing (metal), Cp the heat-capacity rate of the drilling fluid, R1 the inside radius of the drill string, R2 the outside radius of the drill string, Rt the radius of the annulus, Rf the effective radius (for heat supply) around the well, D the flow rate of the drilling fluid, ρ the density of the drilling fluid.

The heat balances per unit of depth are as follows:

Heat supplied by the medium surrounding the well to the fluid in the $$Q_1 = \frac{2\Pi\lambda_f}{\ln\left(\frac{R_t}{R_f}\right)}(\theta_2 - \theta_f)$$

annulus:

Heat carried from the fluid in the annulus to the fluid within the drill string:

Heat accumulated by the fluid in the drill string and in the annulus:

$$Q_2 = \frac{2\Pi\lambda_a}{\ln\left(\frac{R_2}{R_1}\right)}(\theta_1 - \theta_2)$$

$$Q_t = -D.\rho.C_p\Delta\theta_1$$

$$Q_a = D.\rho.C_p\Delta\theta_2.$$

The heat balances lead to the following system:

$$Q_t = Q_2$$

$$Q_a = Q_1 + Q_2.$$

That is $$\frac{d\theta_2}{dz} = \frac{2\Pi\lambda_f}{D\rho C_p\ln\left(\frac{R_t}{R_f}\right)}(\theta_2 - \theta_f) - \frac{2\Pi\lambda_a}{D\rho C_p\ln\left(\frac{R_2}{R_1}\right)}(\theta_1 - \theta_2)$$

$$\frac{d\theta_1}{dz} = -\frac{2\Pi\lambda_a}{D\rho C_p\ln\left(\frac{R_2}{R_1}\right)}(\theta_1 - \theta_2)$$

These equations are solved by diagonalization and matrix inversion , and they lead to the following results:

$$\theta_1(z) = -K_1Be^{r1.z} - K_2Be^{r2.z} + \theta_f - \frac{\alpha}{B}$$

$$\theta_2(Z) = -K_1(B+r_1)e^{r1.z} - K_2(B+r_2)e^{r2.z} + \theta_f$$

with:

$$A = \frac{2\Pi\lambda_f}{D\rho C_p\ln\left(\frac{R_t}{R_f}\right)} \quad B = \frac{2\Pi\lambda_a}{D\rho C_p\ln\left(\frac{R_2}{R_1}\right)} \quad r_1 = \frac{A + \sqrt{A^2 + 4AB}}{2} \quad r_2 = \frac{A - \sqrt{A^2 + 4AB}}{2}$$

$\theta_f = \alpha.z + \theta_0$ being the thermal equation of the medium surrounding the well and $\alpha$ the thermal gradient.

$K_1$ and $K_2$ are the integration constants depending on the boundary conditions.

It is thus possible, by means of some simplifying hypotheses, to obtain an analytic expression for the temperature profile of the drilling fluid in a well. If all the parameters are known, by giving the inlet temperature and by writing that temperatures θ1 and θ2 are equal at the well bottom, the profile is entirely determined. The most commonly used softwares use this type of predictive procedure. However, a study of the results of the models compared to field data shows how difficult it is to use these estimations in a predictive way.

In the present invention, the system is based on the knowledge of three measuring points in the field: inlet temperature, outlet temperature and bottomhole temperature. In order to estimate the thermal profile in the well from the three measurements consisting of the surface injection and outlet temperatures and the bottomhole temperature (inside or outside the drill string), the method according to the invention connects the three measuring points by a general expression representative of the evolution of a thermal profile in a wellbore, as obtained according to the method described above.

Therefore the equations obtained by means of heat exchange calculations as follows are used:

$$\theta_1(z) = -K_1Be^{r1.z} - K_2Be^{r2.z} + \theta_f - \frac{\alpha}{B}$$

$$\theta_2(z) = -K_1(B+r_1)e^{r1.z} - K_2(B+r_2)e^{r2.z} + \theta_f$$

According to the invention, these curve forms are adjusted to the three measuring points of the drilling fluid temperature at the inlet, T1, at the well bottom, T2, and at the well outlet, T3. In order to use these three measuring points as boundary conditions, the two equations (in the drill string and in the annulus) are decoupled by using different integration constants while keeping the general expression. Two general expressions of the temperature profile are obtained in the drill string, θ1, and in the annulus, θ2, which have a physical significance but which comprise two degrees of freedom. Thus, expressions θ1 and θ2 can be adjusted by fixing the degrees of freedom in order to meet the temperature conditions T1, T2 and T3. Therefore the equations in the pipes and in the annulus have the form as follows:

$$\theta_1(z) = -K_1 Be^{r1.z} - K_2 Be^{r2.z} + \theta_f - \frac{\alpha}{B}$$

$$\theta_2(z) = -K_3(B+r_1)e^{r1.z} - K_4(B+r_2)e^{r2.z} + \theta_f.$$

Four integration constants $K_1$, $K_2$, $K_3$ and $K_4$ are obtained rather than two, which requires four boundary conditions to determine the temperature profile. These four boundary conditions are: measurements of the well inlet, bottomhole and outlet temperature, and an equality condition at the bottom between the temperature in the drill string, θ1, and the temperature in the annulus, θ2. The profile can be adjusted at any time to pass through the measuring points: therefore a real-time estimation of the thermal profile is obtained. Programming by means of a spreadsheet type software allows ready obtaining of the real-time evolution of the profile.

Figure 2:
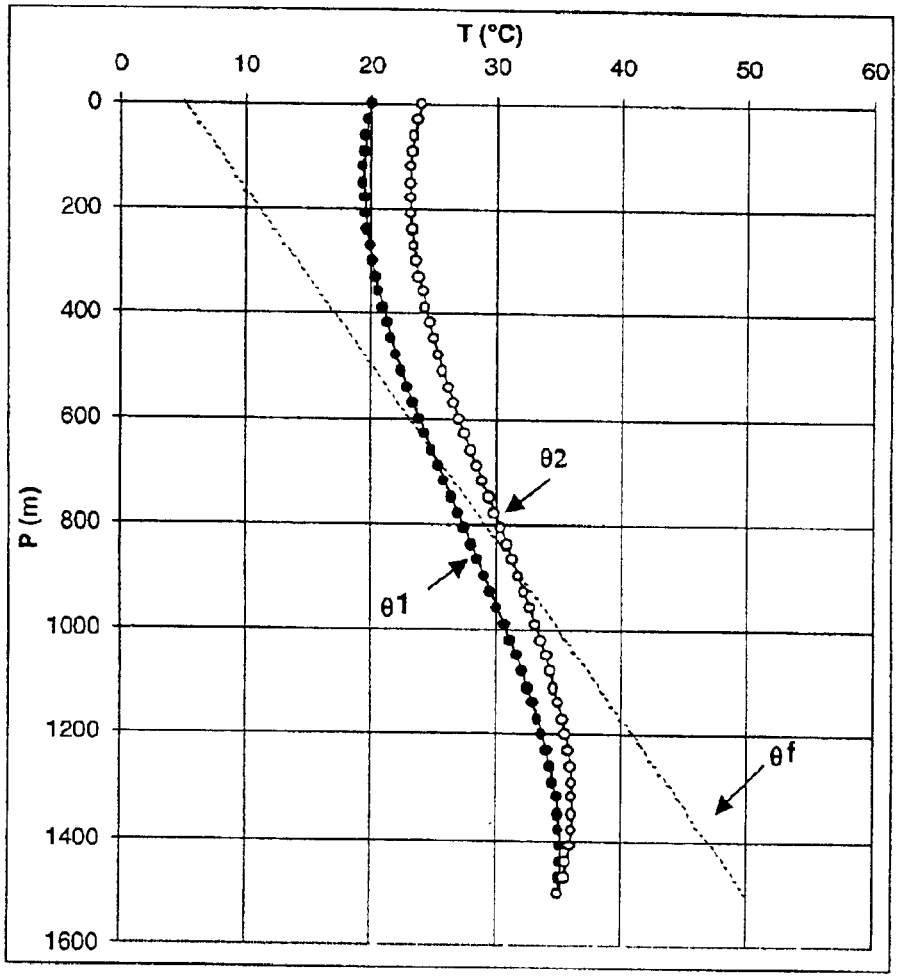
FIGS. 2, 3 and 4 show the form of the temperature profile of the drilling fluid in a vertical onshore well.
Figure 3:
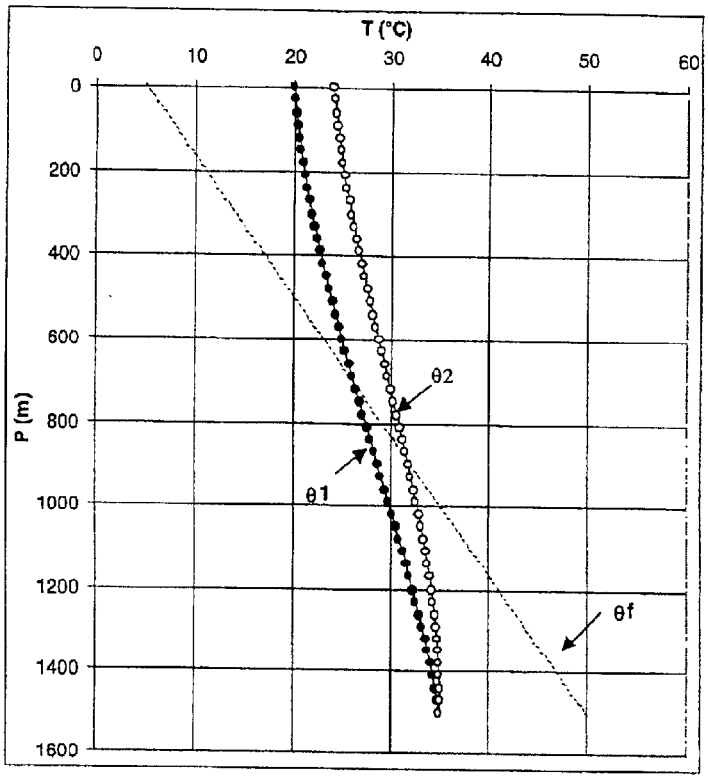
Figure 4:
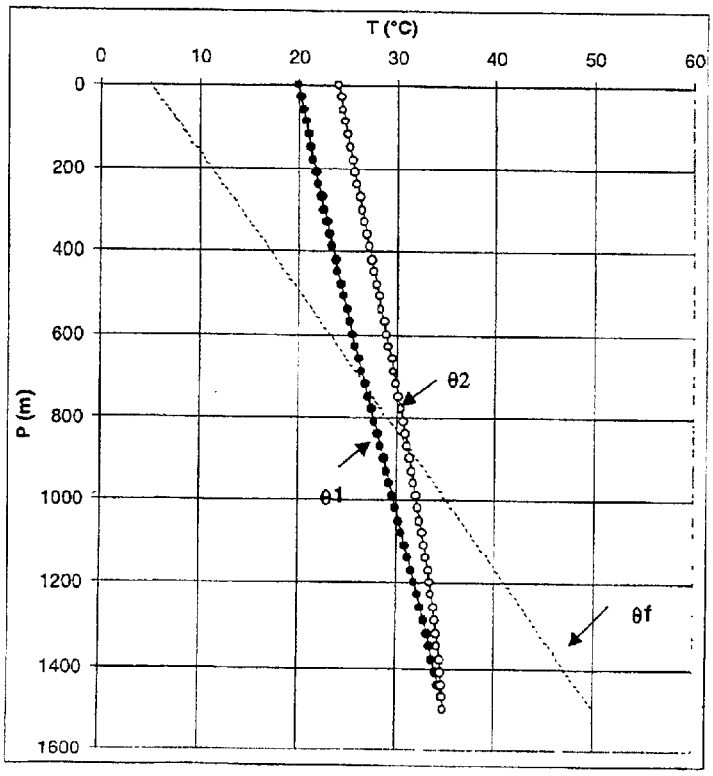

FIGS. 2, 3 and 4 respectively show the temperature profile of the drilling fluid in a vertical onshore well at a flow rate of 500 l/min, 1000 l/min and 2000 l/min. The analytic expression determined allows simple calculation of the temperature T in Celsius degrees of the fluid in the drill string (curve θ1) and in the annulus (curve θ2) as a function of the depth P in meter. The analytic expression depends on several parameters that can be fixed from the start. By default typical values of these parameters are used. To determine the temperature profile of FIGS. 2, 3 and 4, the geothermal gradient α is assumed to be constant to correspond to the onshore situation of the well. The temperature profile is entirely determined by measuring the temperature, 20° C. at the inlet, 35° C. at the bottom and 24° C. at the outlet of the well.

The case of the vertical offshore well can be addressed by considering that the geothermal profile of the medium surrounding the well is divided in two domains: let θm be the thermal profile of the sea and θs the thermal profile of the ground. Thermal gradient α is assumed to be constant in each domain, but discontinuous exist from one domain to the other. Let αm be the thermal gradient of the sea and αs the thermal gradient of the ground. Two series of equations (one for each domain) are considered for each general expression in the pipes and in the annulus. Four decoupled equations are obtained which represent the thermal profile of the drilling fluid in the well. Equation θ11(z) corresponds to the temperature profile in the drill string in the sea, θ12(z) corresponds to the temperature profile in the drill string in the ground, θ21(z) corresponds to the temperature profile in the annulus in the ground and θ22(z) corresponds to the temperature profile in the annulus in the sea, θ11 being independent of θ12 and θ21 being independent of θ22:

$$\theta_{11}(z) = -K_1 Be^{r1.z} - K_2 Be^{r2.z} + \theta_m - \frac{\alpha s}{B}$$

$$\theta_{12}(z) = -K_3 Be^{r1.z} - K_4 Be^{r2.z} + \theta_s - \frac{\alpha m}{B}$$

$$\theta_{21}(z) = -K_5(B+r_1)e^{r1.z} - K_6(B+r_2)e^{r2.z} + \theta_s$$

$$\theta_{22}(z) = -K_7(B+r_1)e^{r1.z} - K_8(B+r_2)e^{r2.z} + \theta_m$$

Figure 5:
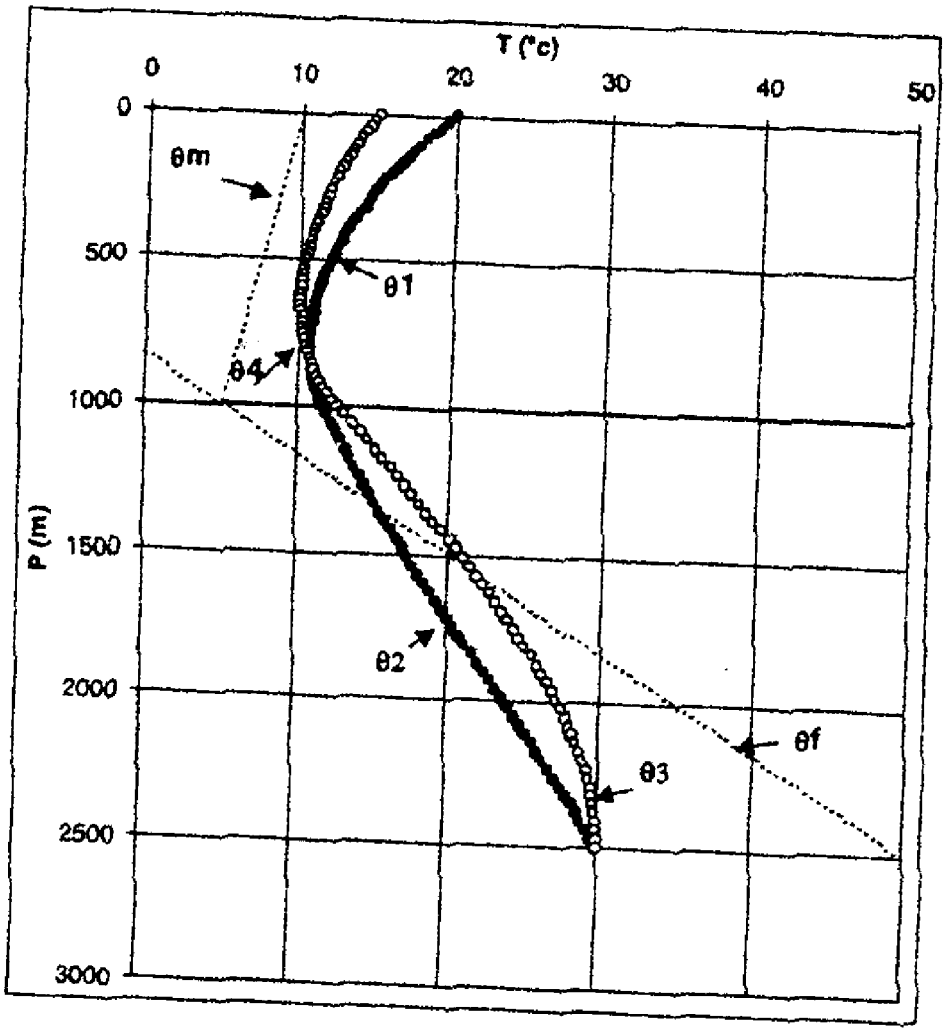
FIG. 5 shows the form of the temperature profile of the drilling fluid in a vertical offshore well.

This brings the number of integration constants to eight ($K_1$ to $K_8$). The boundary conditions are then: measurements of the inlet, outlet and bottomhole temperature, equality condition at the bottom between the pipe temperature and the annulus temperature, to which the continuity of the thermal profiles is added in the drill string and in the annulus at the junction of the two domains and the continuity of the derivative of the thermal profiles in the drill string and in the annulus at the junction of the two domains. Similarly, it is then possible to obtain in real time a physically realistic thermal profile passing through the measuring points. FIG. 5 shows the thermal temperature profile of a drilling fluid in an offshore well from the four equations θ11, θ12, θ21 and θ22. The fluid circulates at 500 l/min and the temperatures measured are 20° C. at the inlet, 15° C. at the outlet and 30° C. at the well bottom. The thermal gradients are selected constant in each domain crossed by the well.

Deviated wells represent the majority of the current wellbores. The physical problem is not fundamentally different and it can be handled in the same way as offshore wellbores: the well just has to be divided into two domains, each domain being characterized by a different thermal gradient corresponding to the medium surrounding the well. In the case of a deviated well, the depth corresponds to the distance covered along the well trajectory. General expressions θ1 and θ2 representative of the thermal profile are each split up into two independent equations. The vertical part is characterized by the thermal gradient a of the medium surrounding the well, the deviated part is characterized by an equation of the thermal profile of the medium surrounding the well $\theta_d = \alpha.\sin(\phi).z + \theta_0$, φ being the angle of inclination. The same boundary conditions (measurements of the temperature at the inlet, at the outlet and at the bottom of the well, equality at the bottom between the pipe temperature and the annulus temperature, and continuity of the thermal profiles and of the derivative of the thermal profiles in the drill string and in the annulus at the junction of the two domains) then allow solving the equations and obtaining the expression of the temperature profile in the pipes and in the annulus.

Figure 6:
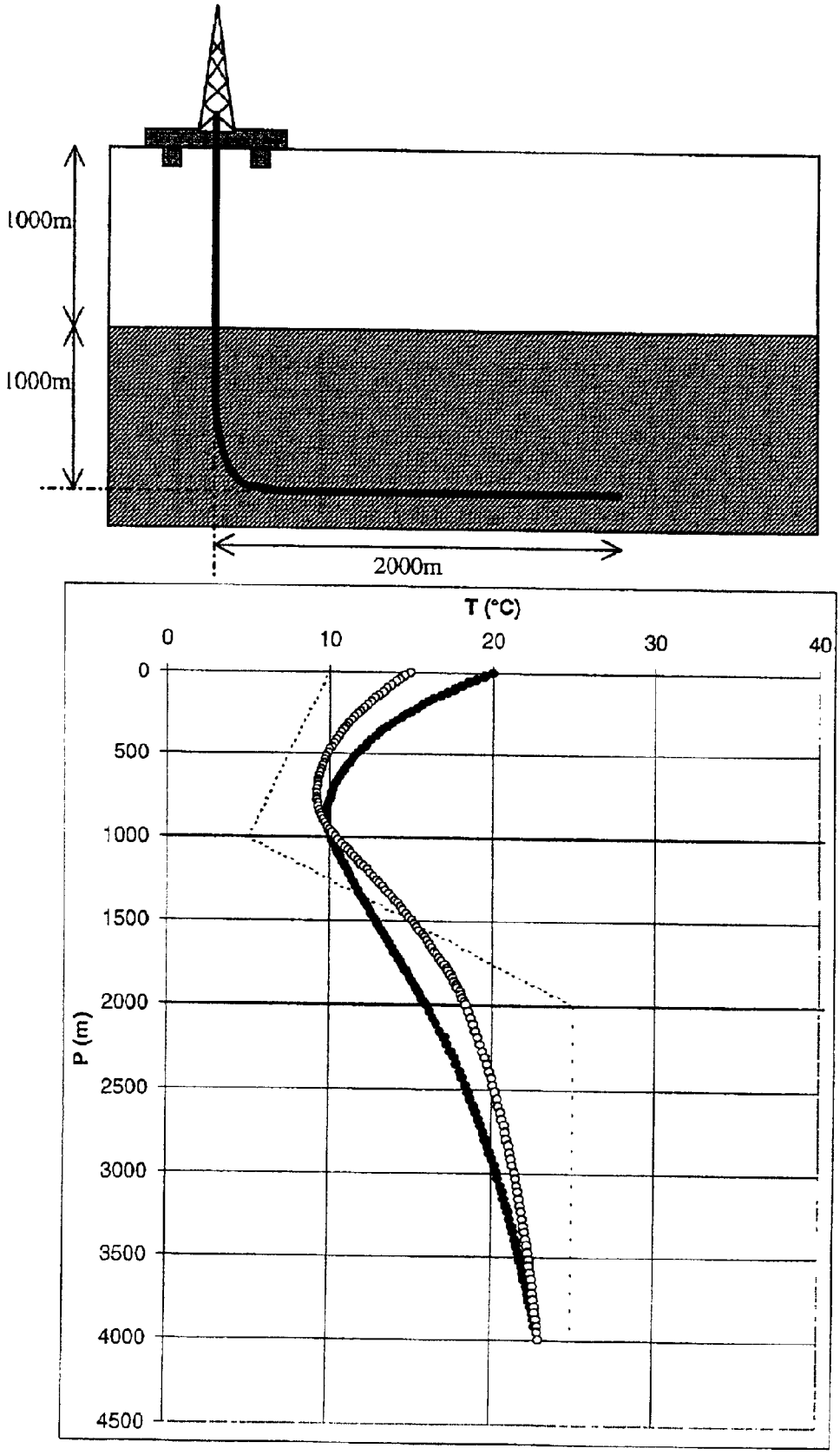
FIG. 6 shows the form of the temperature profile of the drilling fluid in a deviated offshore well.

It is possible to combine the procedure applied for a vertical offshore well and the procedure applied for a deviated onshore well in order to determine the temperature profile in an offshore well when the direction of the hole is deviated in the ground. The domain is divided into three different domains: let θm be the thermal profile of the vertical domain in the sea, θs the thermal profile of the vertical domain in the ground and θd the thermal profile of the deviated domain in the ground. FIG. 6 shows the thermal profile in a deviated offshore well. The fluid circulates at 500 l/min and the temperatures measured are 20° C. at the inlet, 23° C. at the bottom and 15° C. at the outlet of the well.

According to the same method as that used for the vertical offshore well or for the deviated onshore well, it is possible to determine the thermal profile of a vertical onshore well whose formation thermal gradient changes as a function of the depth. The well is divided into domains characterized by a thermal equation of the medium surrounding the well. General expressions θ1 and θ2 representative of the thermal profile are then each split up into as many independent equations as there are different domains. The same boundary conditions (measurements of the temperature at the inlet, at the outlet and at the bottom of the well, equality at the bottom between the pipe temperature and the annulus temperature, and continuity of the thermal profiles and of the derivative of the thermal profiles in the drill string and in the annulus at the junction of the two domains) then allow solving the equations and obtaining the expression of the temperature profile in the pipes and in the annulus.

Figure 7:
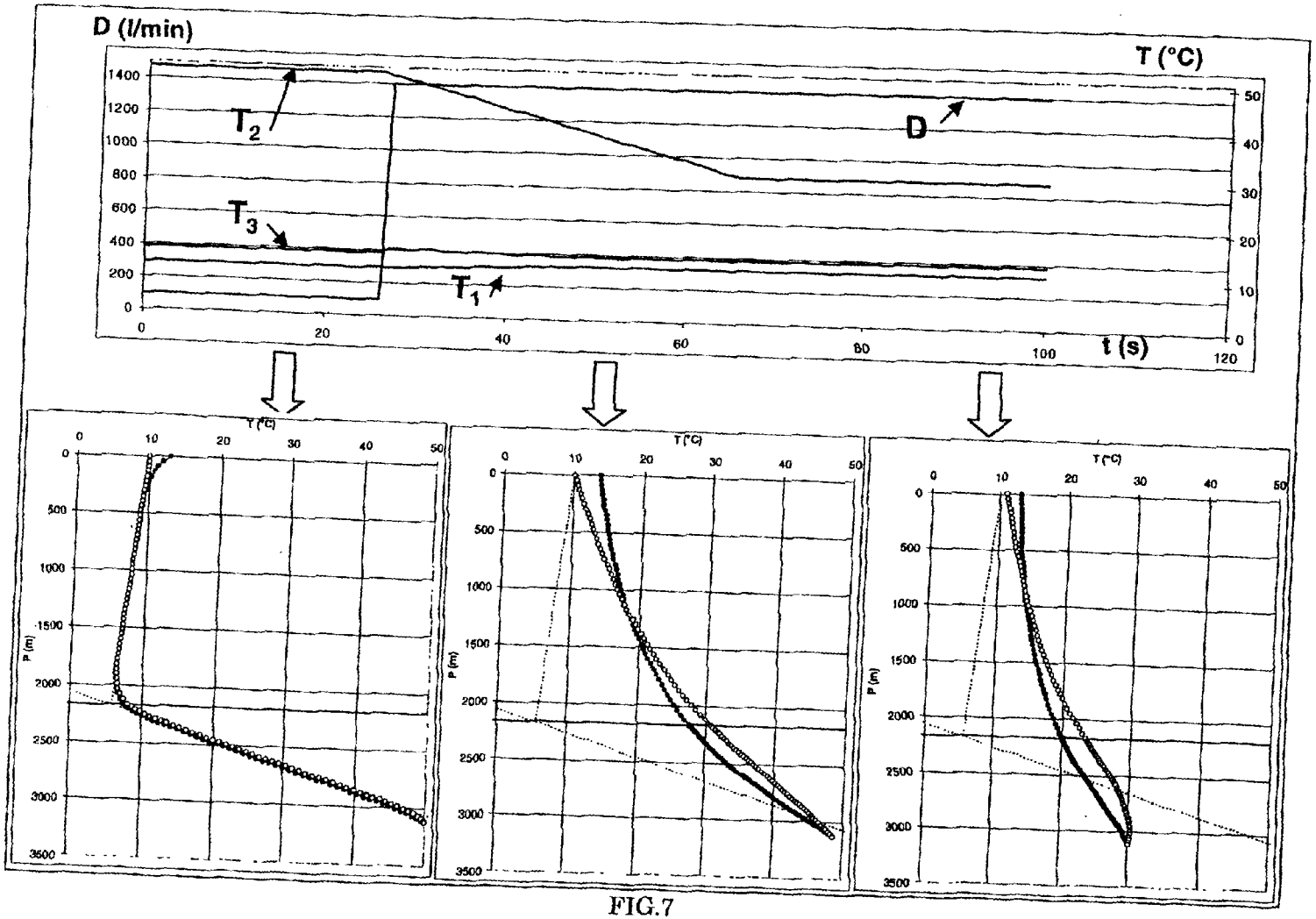
FIG. 7 shows the evolution as a function of time of the temperature profile of the drilling fluid in a vertical offshore well.

By repeating the calculation allowing obtaining the expression of the temperature profile of the drilling fluid upon each new temperature measurement, a representation of the temperature profile evolving with time is obtained. FIG. 7 shows the evolution of the temperature profile of the drilling fluid in an offshore well in the course of time. The graph in the upper part of FIG. 7 shows the evolution as a function of time t in seconds of the flow rate parameter D in l/min of the drilling fluid, and of the temperature parameter T in ° C of the drilling fluid at the inlet, T1, at the bottom, T2, and at the outlet, T3, of the well. The three graphs in the lower part show the temperature profile at three different times and allow to observe the evolution thereof.

Knowledge of the thermal profile of the drilling fluid at any time allows real-time calculation of the pressure drops in the well by taking into account the thermal effects. This gives a better estimation of the bottomhole pressures and of the injection pressures for complex wells.

Another use of real-time determination of the thermal profile of the drilling fluid is hydrate formation prevention. Hydrates form under low temperature and high pressure conditions, conditions which are met notably in deep offshore wells at the ground/sea interface. Knowledge of the temperature profile allows determination of the zones where the temperature of the drilling fluid is below the minimum value from which hydrates form, then to react accordingly, for example by raising the flow rate or by heating the fluid in order to prevent this formation of hydrates.

What is claimed is:

1. A method of determining a thermal profile of a drilling fluid circulating in a well during drilling, comprising the steps;

a) determining an expression θ1 of a thermal profile of the drilling fluid inside the drill string in the well and a expression θ2 of a thermal profile of the drilling fluid in an annulus surrounding the drill string, using a heat propagation equation accounting for a thermal profile of a medium surrounding the well;

b) measuring a temperature T1 of the drilling fluid at a well inlet, a temperature T2 at a bottom of the well, and a temperature T3 at a well outlet; and wherein c) the expressions θ1 and θ2 meet temperature boundary conditions of T1, T2 and T3.

2. A method as claimed in claim 1 comprising, after step c):

d) providing a drilling fluid having a thermal profile which is a function of the depth.

3. A method as claimed in claim 2 wherein:

repeating steps b), c) and d) to obtain a real-time temperature profile.

4. A method as claimed in claim 3, wherein:

in step a), expressions θ1 and θ2 comprise unknown constants; and, in step c), expressions θ1 and θ2 are made to meet the boundary temperature conditions T1, T2 and T3 by determining the unknown constants.

5. A method as claimed in claim 3, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

6. A method as claimed in claim 3 wherein:

in step a) a heat propagation equation accounting for at least a thermal equation of the medium surrounding the well, a flow rate of the drilling fluid and a balance of thermal exchanges undergone by the drilling fluid are used and the thermal exchanges comprise at least exchanges between ascending and descending drilling fluid.

7. A method as claimed in claim 2, wherein:

in step a), expressions θ1 and θ2 comprise unknown constants; and in step c), expressions θ1 and θ2 are made to meet the boundary temperature conditions T1, T2 and T3 by determining the unknown constants.

8. A method as claimed in claim 7 wherein:

in step a) a heat propagation equation accounting for at least a thermal equation of the medium surrounding the well, a flow rate of the drilling fluid and a balance of thermal exchanges undergone by the drilling fluid are used and the thermal exchanges comprise at least exchanges between ascending and descending drilling fluid.

9. A method as claimed in claim 7, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

10. A method as claimed in claim 7, applied to a vertical offshore well wherein:

in step a) each expression θ1 and θ2 are split into independent equations by accounting for a thermal profile of the medium surrounding the well; and in step c) the thermal profiles and derivatives of the thermal profiles of the drilling fluid within the drill string and in the annulus surrounding the drill string are continuous.

11. A method as claimed in claim 2 wherein:

in step a) a heat propagation equation accounting for at least a thermal equation of the medium surrounding the well, a flow rate of the drilling fluid and a balance of thermal exchanges undergone by the drilling fluid are used and the thermal exchanges comprise at least exchanges between ascending and descending drilling fluid.

12. A method as claimed in claim 11, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

13. A method as claimed in claim 11, applied to a vertical offshore well wherein:

in step a) each expression θ1 and θ2 are split into independent equations by accounting for a thermal profile of the medium surrounding the well; and in step c) the thermal profiles and derivatives of the thermal profiles of the drilling fluid within the drill string and in the annulus surrounding the drill string are continuous.

14. A method as claimed in claim 2, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

15. A method as claimed in claim 12 wherein:

in step a) expressions θ1 and θ2 are each split into independent equations; and in step c) the thermal profiles and derivatives of the thermal profiles of the fluid within the drill string and in the annulus surrounding the drill string are continuous.

16. A method as claimed in claim 1 wherein:

repeating steps b), c) and d) to obtain a real-time temperature profile.

17. A method as claimed in claim 16, wherein:

in step a), expressions θ1 and θ2 comprise unknown constants; and in step c), expressions θ1 and θ2 are made to meet the boundary temperature conditions T1, T2 and T3 by determining the unknown constants.

18. A method as claimed in claim 16 wherein:

in step a) a heat propagation equation accounting for at least a thermal equation of the medium surrounding the well, a flow rate of the drilling fluid and a balance of thermal exchanges undergone by the drilling fluid are used and the thermal exchanges comprise at least exchanges between ascending and descending drilling fluid.

19. A method as claimed in claim 16, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

20. A method as claimed in claim 16 wherein:

in step a) expressions θ1 and θ2 are each split into independent equations; and in step c) the thermal profiles and derivatives of the thermal profiles of the fluid within the drill string and in the annulus surrounding the drill string are continuous.

21. A method as claimed in claim 1, wherein:

in step a), expressions θ1 and θ2 comprise unknown constants; and in step c), expressions θ1 and θ2 are made to meet the boundary temperature conditions T1, T2 and T3 by determining the unknown constants.

22. A method as claimed in claim 21 wherein:

in step a) a heat propagation equation accounting for at least a thermal equation of the medium surrounding the well a flow rate of the drilling fluid and a balance of thermal exchanges undergone by the drilling fluid are used and the thermal exchanges comprise at least exchanges between ascending and descending drilling fluid.

23. A method as claimed in claim 21, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

24. A method as claimed in claim 21 wherein:

in step a) expressions θ1 and θ2 are each split into independent equations; and in step c) the thermal profiles and derivatives of the thermal profiles of the fluid within the drill string and in the annulus surrounding the drill string are continuous.

25. A method as claimed in claim 1 wherein:

in step a) a heat propagation equation accounting for at least a thermal equation of the medium surrounding the well, a flow rate of the drilling fluid and a balance of thermal exchanges undergone by the drilling fluid are used and the thermal exchanges comprise at least exchanges between ascending and descending drilling fluid.

26. A method as claimed in claim 25, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

27. A method as claimed in claim 25 wherein:

in step a) expressions θ1 and θ2 are each split into independent equations; and in step c) the thermal profiles and derivatives of the thermal profiles of the fluid within the drill string and in the annulus surrounding the drill string are continuous.

28. A method as claimed in claim 1, wherein:

in step a) a heat propagation equation in the medium which is homogeneous on a cylinder of infinite height centered on the well is used, the cylinder comprising the drill string that guides descending drilling fluid and an annulus surrounding the drill string which guides ascending drilling fluid.

29. A method as claimed in claim 28 wherein:

in step a) expressions θ1 and θ2 are each split into independent equations; and in step c) the thermal profiles and derivatives of the thermal profiles of the fluid within the drill string and in the annulus surrounding the drill string are continuous.

30. A method as claimed in claim 1 wherein:

in step a) expressions θ1 and θ2 are each split into independent equations; and in step c) the thermal profiles and derivatives of the thermal profiles of the fluid within the drill string and in the surrounding annulus are continuous.

31. A method as claimed in claim 30, applied to a vertical offshore well wherein:

in step a) each expression θ1 and θ2 are split into independent equations by accounting for a thermal profile of the medium surrounding the well; and in step c) the thermal profiles and derivatives of the thermal profiles of the drilling fluid within the drill string and in the annulus surrounding the drill string are continuous.

32. A method as claimed in claim 1, applied to a vertical offshore well wherein:

in step a) each expression θ1 and θ2 are split into independent equations by accounting for a thermal profile of the medium surrounding the well; and in step c) the thermal profiles and derivatives of the thermal profiles of the drilling fluid within the drill string and in the annulus surrounding the drill string are continuous.

33. A method as claimed in claim 32, applied to a vertical offshore well wherein:

in step a) each expression θ1 and θ2 are split into independent equations by accounting for a thermal profile of the medium surrounding the well; and in step c) the thermal profiles and derivatives of the thermal profiles of the drilling fluid within the drill string and in the annulus surrounding the drill string are continuous.

34. A use of the method as claimed in claim 1, wherein:

calculation of pressure drops of the drilling fluid circulating in the well during drilling are made.

35. A method as claimed in claim 34, applied to a vertical offshore well wherein:

in step a) each expression θ1 and θ2 are split into independent equations by accounting for a thermal profile of the medium surrounding the well; and in step c) the thermal profiles and derivatives of the thermal profiles of the drilling fluid within the drill string and in the annulus surrounding the drill string are continuous.

36. The heat balances per unit of depth are as follows:

Heat supplied by the medium surrounding the well to the fluid in the annulus:

$$Q_1 = \frac{2\Pi\lambda_f}{\ln\left(\frac{R_t}{R_f}\right)}(\theta_2 - \theta_f)$$

Heat carried from the fluid in the annulus to the fluid within the drill string:

Heat accumulated by the fluid in the drill string and in the annulus:

$$Q_t = -D.\rho.C_p\Delta\theta_1$$

$$Q_2 = \frac{2\Pi\lambda_a}{\ln\left(\frac{R_2}{R_1}\right)}(\theta_1 - \theta_2)$$

$$Q_a = D.\rho.C_p\Delta\theta_2.$$

* * * * *